US006886448B2

(12) United States Patent
Urvoy

(10) Patent No.: US 6,886,448 B2
(45) Date of Patent: May 3, 2005

(54) SYSTEM FOR DIRECTIONAL ANGLE AIMING OF A WEAPON

(75) Inventor: Emile Urvoy, Roussigny (FR)

(73) Assignee: Giat Industries, Versailles (FR)

( * ) Notice: Subject to any disclaimer, the term of this patent is extended or adjusted under 35 U.S.C. 154(b) by 0 days.

(21) Appl. No.: 10/483,781

(22) PCT Filed: Jul. 15, 2002

(86) PCT No.: PCT/FR02/02506

§ 371 (c)(1),
(2), (4) Date: Jan. 14, 2004

(87) PCT Pub. No.: WO03/008894

PCT Pub. Date: Jan. 30, 2003

(65) Prior Publication Data

US 2004/0200348 A1 Oct. 14, 2004

(30) Foreign Application Priority Data

Jul. 17, 2001 (FR) ..... 01 09509

(51) Int. Cl.[7] ..... F41A 25/22
(52) U.S. Cl. ..... 89/37.07; 89/37.13
(58) Field of Search ..... 89/37.03, 37.05, 89/37.07, 37.13, 40.02, 40.03, 40.04, 40.09, 41.09, 41.11, 41.17

(56) References Cited

U.S. PATENT DOCUMENTS

| | | | | | |
|---|---|---|---|---|---|
| 1,880,174 | A | * | 9/1932 | Dugan | 89/41.11 |
| 2,339,508 | A | * | 1/1944 | Newell | 89/200 |
| 4,387,624 | A | | 6/1983 | Bjurstrom | 89/41.15 |
| 5,048,392 | A | * | 9/1991 | Ruttgerodt et al. | 89/41.02 |
| 5,864,085 | A | * | 1/1999 | Begneu et al. | 89/37.07 |

FOREIGN PATENT DOCUMENTS

| | | | | |
|---|---|---|---|---|
| DE | 32 41 665 A1 | | 5/1984 | |
| EP | 0 179 387 A2 | | 4/1986 | |
| FR | 2 421 362 | | 10/1979 | |
| GB | 8645 | * | 6/1915 | 89/37.07 |
| GB | 633866 | * | 12/1949 | 89/41.09 |

* cited by examiner

*Primary Examiner*—Stephen M. Johnson
(74) *Attorney, Agent, or Firm*—Oliff & Berridge, PLC

(57) ABSTRACT

A traverse laying system for a weapon integral with a frame articulated in traverse with respect to a support providing a large traverse range around a first axis of rotation. The system includes positioning device for the weapon integral with the frame in order to ensure a small lateral range of the weapon around a second axis of rotation passing through the centre of gravity and perpendicular respectively to the longitudinal axis of the weapon and the traverse orientation axis. The first axis of rotation is located to the rear of the weapon's centre of gravity and the lateral range around the second axis may be of around 2°.

10 Claims, 4 Drawing Sheets

SYSTEM FOR DIRECTIONAL ANGLE AIMING OF A WEAPON

BACKGROUND OF THE INVENTION

1. Field of Invention

The technical scope of the present invention is that of laying systems for a weapon ensuring its stabilisation.

2. Description of Related Art

When a weapon is mounted on a mobile support, that is on a moving vehicle, laying operations become difficult to ensure, since the weapon is subjected to a certain number of disturbances. Firing from such a weapon requires it to be oriented in the direction of the target and this despite any movements, be they linear or angular, of the vehicle. One particularity of a vehicle able to move at high speeds (more than 50 km/h) cross country lies in the stresses it causes to the weapon and to its laying system and which generally correspond to a high level and cover a wide spectrum.

During displacements of the vehicle, these disturbances may notably come from:

the angular velocity of the support of which the weapon is mounted and which reach the weapon via the motorization system, the linear acceleration applied to the turret's axis of rotation via the offsetting the turret's centre of gravity with respect to this axis, the angular acceleration applied directly to the turret by the friction that appears on the circular bearing, friction caused in particular by the sealing means to be set in place between the turret and the chassis, the angular acceleration of the support around an axis perpendicular to the two traverse axes of rotation of the turret and the weapon's elevation axis of rotation via a coefficient depending on the elevation of the weapon.

Three types of limitations deteriorating the traverse orientation efficiency of the weapon may thus be found. Firstly, the weapon's positioning accuracy is adversely affected by the friction because of the presence of a large diameter bearing and its associated seals. Moreover, on the one hand the motorization torque available for the turret limits the possibilities of compensating the roll effect on the orientation of the weapon, whereas on the other, the stabilisation error associated with this type of disturbance is particularly great.

Several methods and devices are known to attenuate the roll effects on the firing performances of a weapon.

A first method consists in measuring the perturbing angular velocity, for example using geometric type means, and using this measurement to control the rotational speed of the motorization system placed between the support and the weapon. It is thus an anticipatory control placed in parallel with a servo control of the weapon's position on an inertial reference whose efficiency is low so as to attenuate the amplitude of the angular disturbances at mean frequencies. Reference may be made, for example, to patent FR-80.21077.

Another method consists in providing motorization means allowing the torque applied to the load to be controlled. This principle is used to improve the efficiency of the reduction of the effects of the angular velocity disturbances. This method is adapted to low offset values. Reference may be made, for example, to patent U.S. Pat. No. 4,387,624.

Yet another method consists in measuring the gyrometric roll velocity and in controlling an angular velocity of the turret that is proportional to this velocity, via a coefficient depending on the elevation of the weapon. Although this method allows the quality of stabilisation provided by the servo-control of the weapon on the inertial reference to be improved, it is firstly limited in efficiency and secondly rapidly reaches the limits of the motorization's torque capacities.

When the elevation of the weapon and the angular roll velocities increase, in spite of the quality of the controls given to the traverse motorization, the quality of the stabilisation deteriorates and the limitations imposed by the size of the motorization in position are rapidly attained.

When driving cross country at high speed, two limitations thus deteriorate the possibility of maintaining good traverse orientation of a weapon laid on a target. Firstly, the weapon's positioning accuracy is affected by the friction because of the presence of a large diameter bearing and its associated seals. Furthermore, on the one hand the torque available for the motorization of the turret limits the possibility of compensating the roll effect on the weapon's acceleration whereas, on the other the error associated with this type of disturbance is great.

SUMMARY OF THE INVENTION

The aim of the present invention is to propose a system that exceeds the limits imposed by the traverse orientation of the weapon and substantially increases the range of compensation possible for the roll disturbances.

The invention thus relates to a traverse laying system for a weapon integral with a frame articulated in traverse with respect to a support providing a large traverse range around a first axis of rotation (G1), wherein it comprises positioning means for the weapon integral with the frame or turret in order to ensure a small lateral range of the weapon around a second axis of rotation (G2) passing through the centre of gravity and perpendicular respectively to the longitudinal axis of the weapon and the traverse orientation axis.

According to one characteristic, the first axis of rotation (G1) is located to the rear of the weapon's centre of gravity.

According to another characteristic, the lateral range around the second axis is of around 2°.

According to another characteristic, the positioning means comprise a mantlet supporting the weapon and integral with the frame and rotation control means.

According to another characteristic, the weapon is mounted by means of a joint with respect to the mantlet, with the positioning means ensuring the rotation of the weapon with respect to the mantlet around the second axis (G2).

According to another characteristic, the joint is of the mechanical or flexible type.

According to another characteristic, the mechanical joint is constituted by a trunnion integral with a cradle placed between the weapon and the mantlet, and bearings integral with the mantlet.

According to another characteristic, the control means are a jack whose body is integral with the mantlet and whose rod is connected to the weapon.

According to another characteristic, the control means are a jack whose body is integral with the weapon and whose rod is connected to the mantlet.

According to another characteristic, the flexible joint is constituted by two trunnions integral with the cradle and connected to the mantlet by flexible means of low angular stiffness around axis G2 and high stiffness around elevation axis S.

According to another characteristic, the secondary articulation means around axis G2 are obtained by the displacement in the opposite direction of two eccentrics.

According to another characteristic, the control means are constituted by two jacks working in opposite directions whose bodies are fastened to the cradle and whose rods are fastened respectively on each of the eccentrics, the minimal flexibility of this motorization being produced by the radial stiffness of elastomer crowns.

A first advantage of the system according to the invention lies in the satisfaction of the absolute orientation quality requirements to be imposed on the weapon through the adoption of a second joint at the centre of gravity allowing a lateral angular displacement of the weapon with respect to the turret.

Another advantage lies in the control of the traverse orientation of the weapon without disturbance to the elevation control.

Another advantage lies in the fact that the disturbing torques applied between the mantlet and the weapon via the second axis of rotation G2 are limited to the driving torque and to the torque caused by the sealing system between the mantlet and the weapon's cradle.

Since the relative mantlet/cradle range is limited, specific sealing means (of the bellows type, for example) may be used to minimise the parasitic constraints.

An additional advantage corresponds to the fact that maintaining the weapon oriented on the target no longer requires the precise rotation of the turret with its associated constraints on the control quality and on the maximum available torque.

Another advantage corresponds to being able to use the principle described in the US patent to motorise the additional axis of rotation G2 with its associated advantages on the positioning quality of the weapon. The corresponding motorization may either be electrical or hydraulic.

An additional advantage of the invention is that the turret's stabilisation quality in traverse can be degraded, the residual errors of the turret being taken up by the additional lateral orientation system.

BRIEF DESCRIPTION OF THE DRAWINGS

Other characteristics, particulars and advantages of the invention will become more apparent from the following description given by way of illustration in relation to the appended drawings, in which.

DETAILED DESCRIPTION OF PREFERRED EMBODIMENTS

We know that a weapon mounted on an armored vehicle classically incorporates a cradle mounted fixed with respect to a mantlet that is articulated around a trunnion axis with respect to the turret or frame. The weapon thus incorporates a recoiling mass that slides longitudinally in the cradle when the weapon is fired.

When the elevation angle of the weapon increases, the angular movements of the vehicle around the roll axis have a direct effect on the weapon's orientation. When this disturbance needs to be compensated, firstly, despite efficient control commands, the sensitivity of the residual error with respect to the disturbance is relatively great and, secondly, the limitation imposed by the maximum acceleration torque dimensioning of the turret's motorization is rapidly attained.

According to the invention, a secondary lateral angular mobility is provided between the cradle and the mantlet connecting it to the turret. This structure makes a rotation possible around an axis perpendicular to the axis of the weapon and to the axis of rotation in elevation, since the weapon is prevented from being driven in roll by the turret and the means to access the available stabilisation efficiency are provided for a system that can take advantage of inertial stabilisation. Furthermore, since the main traverse motorization of the turret has a limited acceleration torque, when this saturation is reached stabilisation may be retained within the limits of the range provided by the second joint allowing the secondary lateral angular mobility mentioned previously.

Preferentially, the secondary axis of articulation is placed axially at the centre of gravity of the articulated laterally mass so as to limit the disturbance caused by the radial acceleration and to limit the dimensioning of the secondary motorization.

As is apparent from the above, the invention consists in providing an additional articulation of the weapon with respect to its frame. A first, or main, joint allows the weapon to be classically oriented in traverse. This joint allows the weapon to be positioned without any angular limitation. A second joint allow the weapon to be oriented in traverse over a limited range and with no elevation and more generally laterally. The advantage of such a system according to the invention lies in the fact that the secondary range between the weapon and the mantlet is, for example, limited to the stabilisation errors around the first axis making it easy to produce. Secondly, since the dimensioning of the second motorization is only linked to the inertia of the weapon to be oriented, efficient torque control may be made without any specific constraints.

Figure 1:
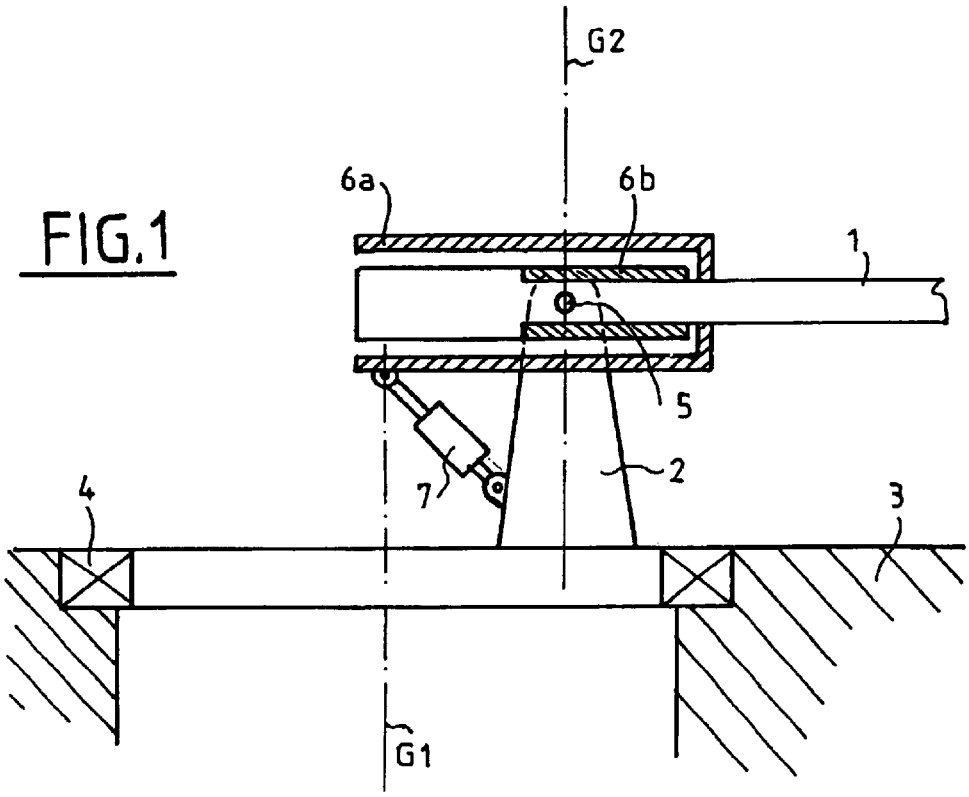
FIG. 1 is a side section view of the weapon.

FIG. 1 schematically shows a vertical section of a weapon 1 mounted on a frame 2 itself mounted on a support 3 by means of a large diameter bearing 4. The support 3 is represented, for example, by the roof of an armored vehicle, either tracked or wheeled. The frame 2, or turret, constitutes the interface between the weapon and the support and it supports the weapon by means of a trunnion 5 that can be seen in the Figure. Classically, the weapon is mounted in a mantlet **6*a* with respect to which it slides inside a cradle 6*b*** during firing. The weapon is thus connected to this mantlet by a certain number of mechanisms, notably brakes, known in themselves and which do not require further description to be able to understand the invention.

The weapon is mobile in elevation in a known manner with respect to the trunnion 5, for example by using a jack 7 connecting the mantlet to the frame 2. It is also mobile in traverse with respect to the support 3 around a main axis G1.

According to the invention, the weapon 1 is mobile in rotation with respect to the mantlet **6*a*** around an axis G2. In the embodiment described, axis G2 is shown passing through the weapon's centre of gravity and axis G1 is located to the rear of the centre of gravity. This arrangement has been preferentially selected, but it goes without saying that axis G1 may occupy any intermediate position.

Figure 2:
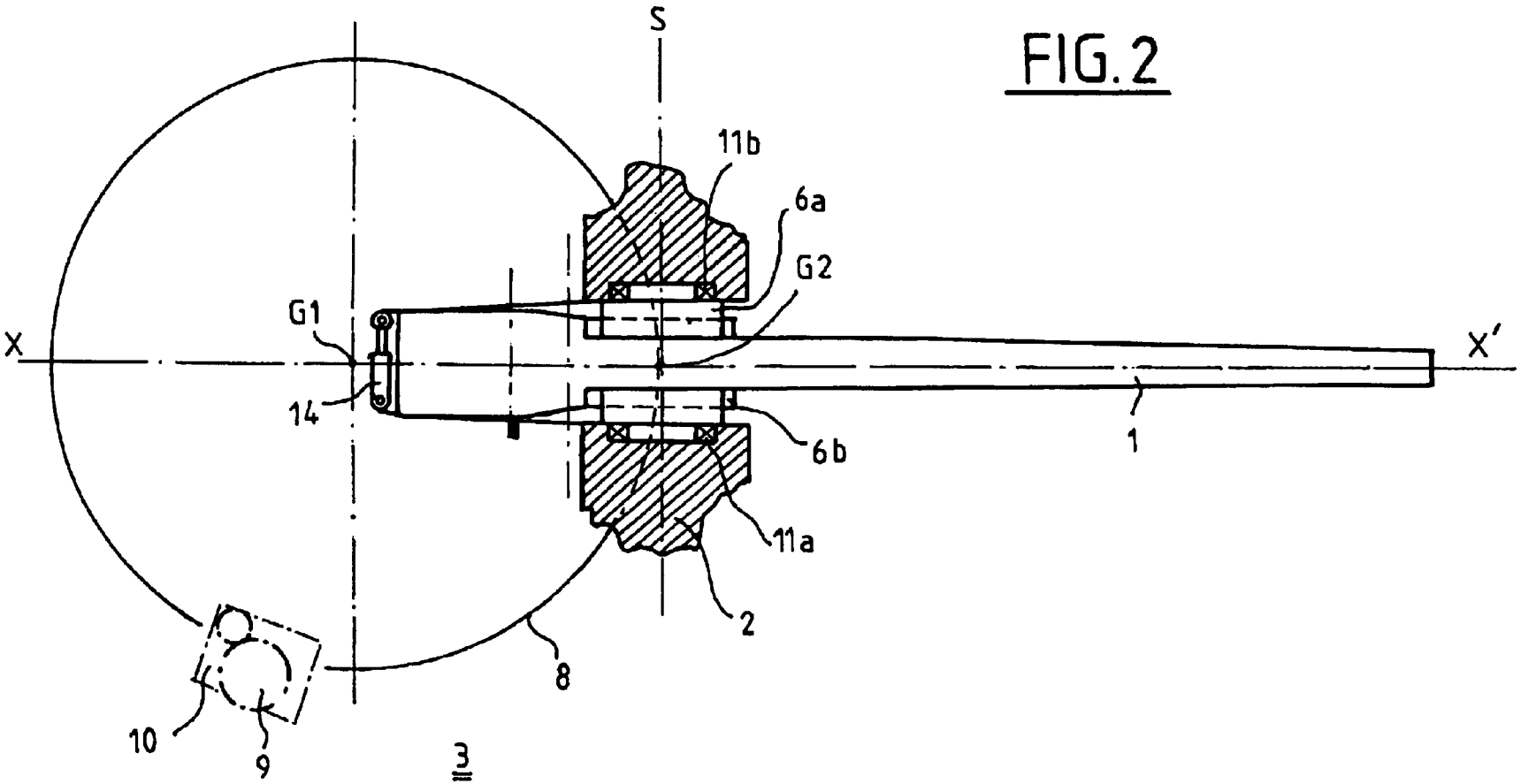
FIG. 2 is a top section view along the longitudinal axis of the weapon.

FIG. 2 shows a top view of the weapon 1 along a section made along its longitudinal axis XX'. This Figure shows the path 8 of travel of the frame 2 or turret with respect to the support. This turret may be mobile in traverse rotation around axis G1 for an angle of 360°. The turret thus drives the weapon 1 to orient it in traverse with no elevation, or laterally. To this end, a motor 9 drives the turret 2 by means of reduction gear 10. The weapon 1 is thus mounted on the frame 2 by means of a mantlet 6*a* itself connected to the frame by two bearings 11*a* and 11*b*. Bearings 11*a* and 11*b* define an elevation axis S of the weapon around which it is driven in rotation by a back-geared motor.

According to one particularity of the invention, the second traverse axis G2 around which the weapon will be activated so as to orient it precisely. A joint is thus provided between the weapon 1 and the mantlet 6*a* and the rotation of said weapon is ensured by rotation control means 14. These means may be, for example, a motor or jack. The body of the jack may be integral with the mantlet and its rod connected to the weapon, or else the body of the jack is integral with the weapon and its rod with the mantlet.

Thanks to this arrangement, a rotation of around 2° of the weapon may be obtained laterally thanks to the positioning means constituted by the mantlet 6*a* and the jack 14. Thus, the weapon may be precisely oriented whatever the roll of the vehicle.

Figure 3:
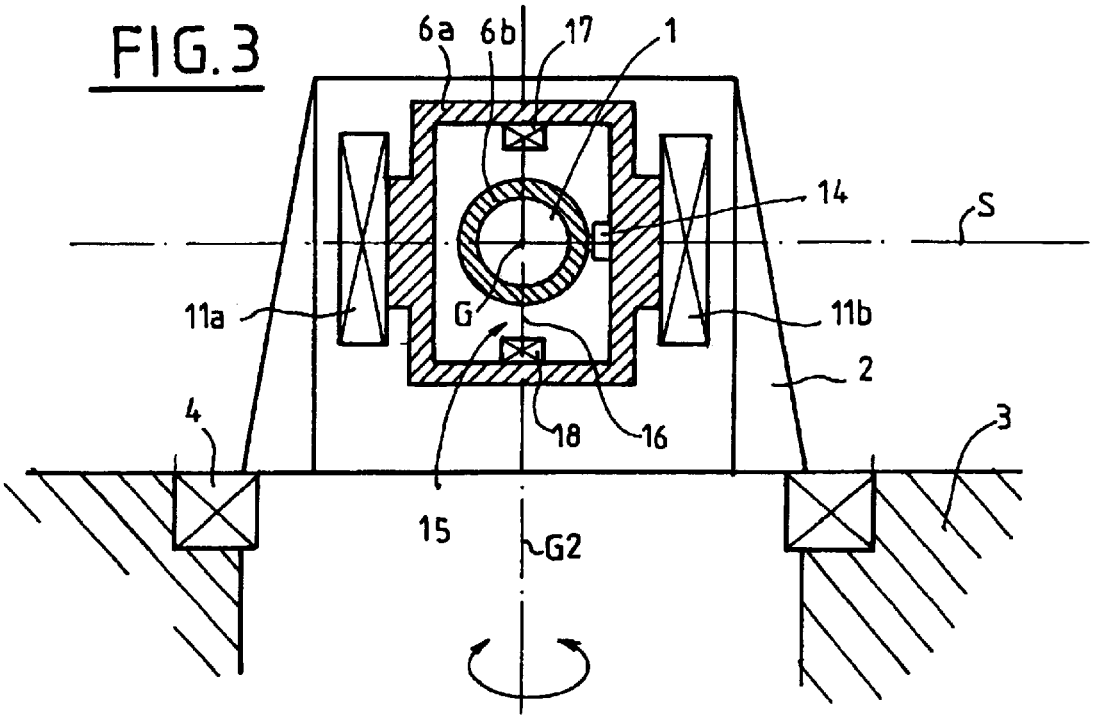
FIG. 3 is a section view of the weapon showing another example of articulation.

FIG. 3 shows a schematic view of the secondary lateral articulation of the weapon 1 with respect to the frame 2 and to bearings 11*a* and 11*b* linking it to the mantlet. The Figure illustrates the articulation between the cradle 6*b* and the mantlet 6*a*. To this end, the cradle 6*b* supporting the weapon 1 is connected to the mantlet 6*a* by a joint 15 to ensure the secondary rotation of said weapon with respect to the mantlet around the second axis G2. In this embodiment, the joint is of the mechanical type and comprises a trunnion 16 engaged in two bearings 17 and 18.

Figure 4:
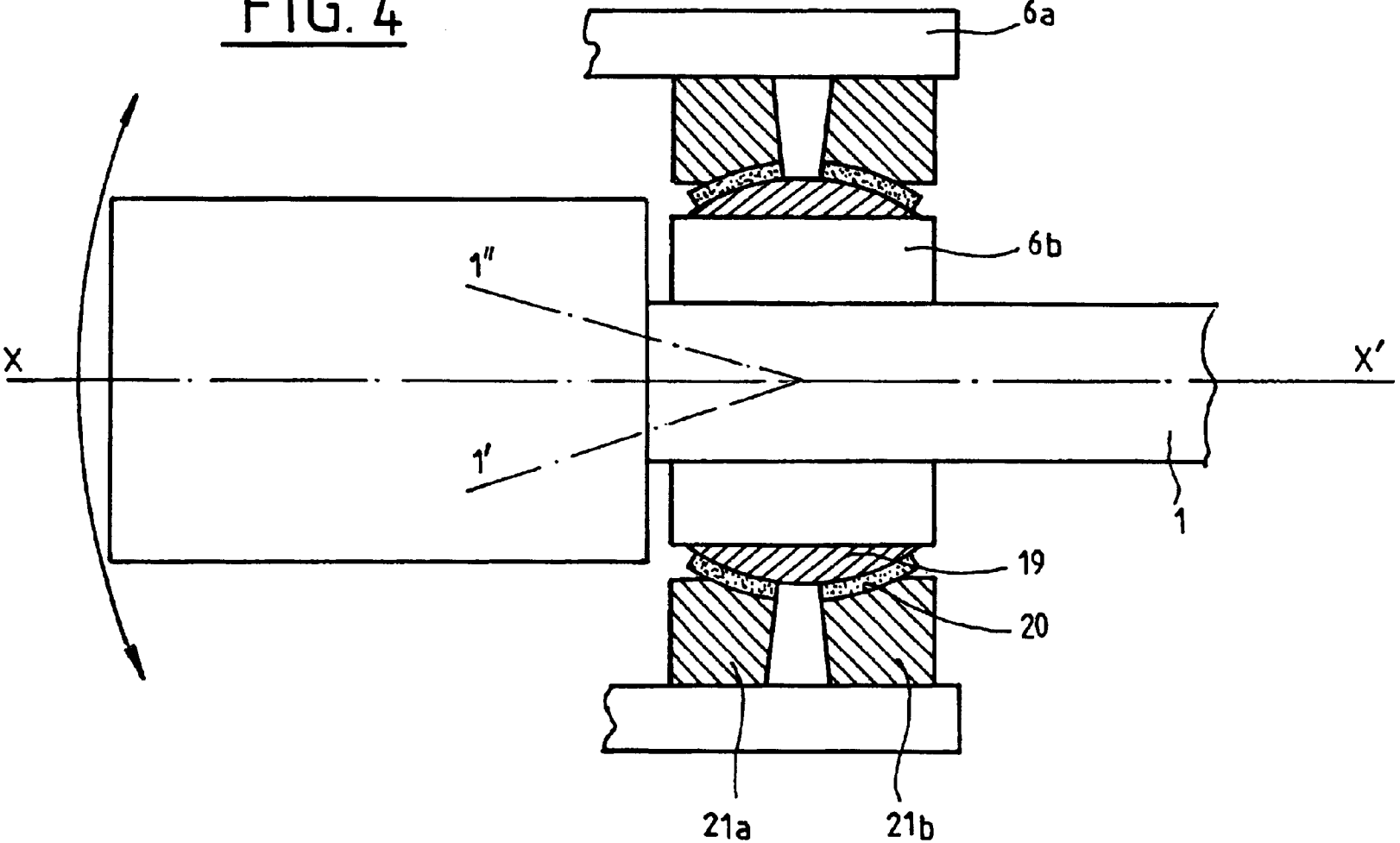
FIG. 4 is a section view of a flexible joint.

The joint may be of the flexible type. FIG. 4 shows an embodiment of a flexible joint. It is constituted by a metallic cylinder 19 into which the cradle is fastened and which is connected by plates of elastomer 20 to the mantlet 6*a* by means of a suitable matching part 21. Part 21 is made in two separate parts 21*a* and 21*b* for reasons of commodity during assembly and are rigidly fastened to the mantlet 6*a*. In this type of joint, the flexible plates 20 are defined by their material firstly to give great stiffness and strength to withstand the axial stresses due to the weapon recoil and, secondly, to have a relatively reduced stiffness with respect to the angular range in traverse up to around 2°. The stiffness associated with this degree of freedom corresponds approximately to a maximal load that must be limited to between 10 and 20% of the maximal load of the associated secondary motorization. A lateral radial stiffness is also specified, parallel to the trunnion axis of the mantlet, that is enough to minimise its effect on the torquing dynamic of the secondary lateral motorization.

More generally, any articulation means may be provided between the cradle and the mantlet allowing a small angular rotation around axis G2. These means must have a limited torque is the range limit around this axis, must be able to transmit the recoil stresses from the weapon to the mantlet, and must have great angular stiffness around the elevation axis between the mantlet and the cradle.

When the weapon 1 has to be oriented, the following operations are carried out. First of all the elevation and traverse angles of the weapon are set in a classical manner. Then, the weapon is finely positioned by activating the jack 14. The weapon 1 will thus swivel, according to FIG. 3, at the trunnions 16 driving the cradle 6*b*, the mantlet 6*a* being in a fixed position thanks to the elevation jack 7. This rotation is naturally carried out for a very small angle of around 2°. According to FIG. 4, when the jack 14 is activated, the cylinder 19 will swivel with respect to the connecting part 21 and the weapon is able to occupy maximal positions 1' and 1" shown on either side of axis XX'.

Figure 5:
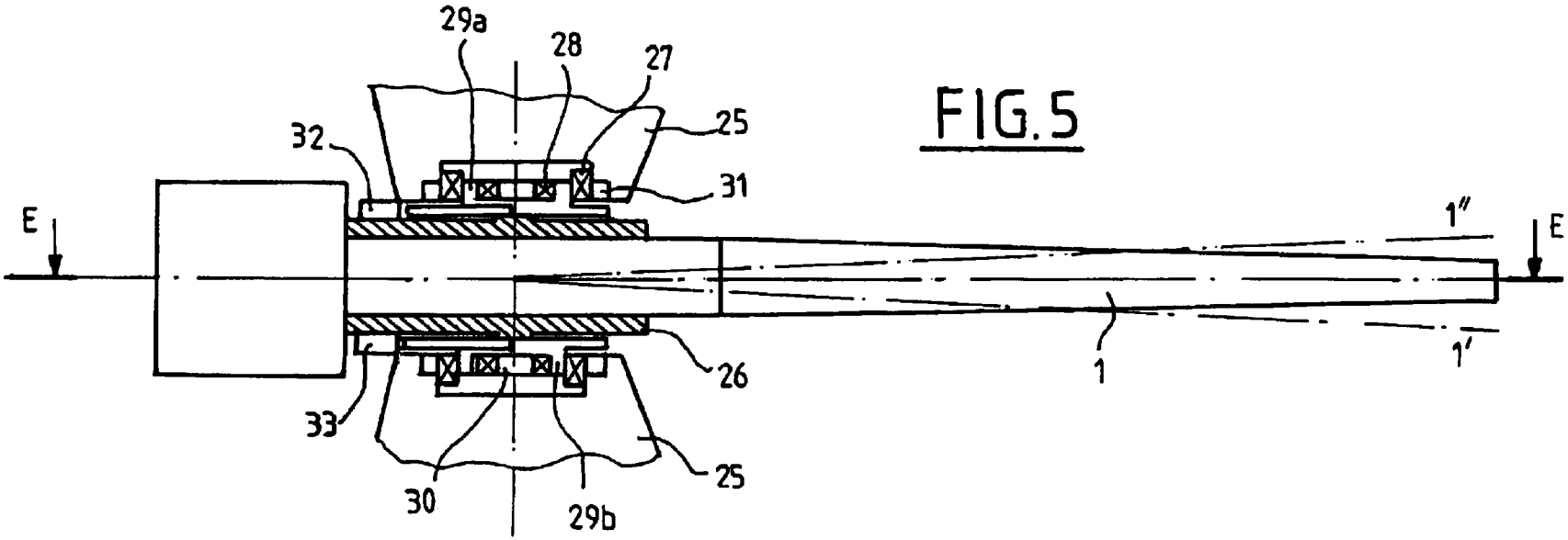
FIG. 5 is a section view of the weapon along longitudinal axis XX' showing another example of flexible articulation.
Figure 6:
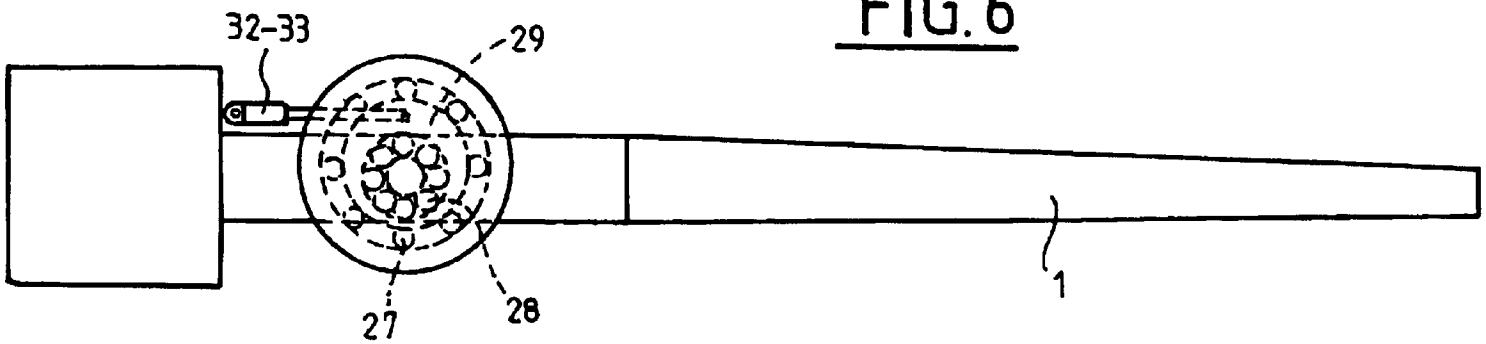
FIG. 6 is a section view along EE in FIG. 5.

Other variant embodiments of the lateral orientation system of the weapon 1 can be envisaged. For example, an articulation may be made for the weapon using two bearings embedded in one another and separated by an eccentric. FIGS. 5 and 6, which are sections along longitudinal axis XX' of the weapon, show this embodiment. The weapon 1 is mounted on a turret 25 by a cradle/mantlet assembly 26 using two bearings 27 and 28 separated by an eccentric 29. The external bearing 27 is large in size and surrounds the internal bearing 28. Bearing 28 allows the cradle 26 to be connected using a trunnion 30, bearing 28 being itself supported by bearing 27, fastened to the turret 25 by means of an elastomer crown 31. This flexible crown works by shearing to allow the axis of bearings 27 and 28 to remain in a perpendicular plane to the weapon axis. The radial stiffness of these flexible links, relatively greater than the tangential stiffness, is used to impose an angular stiffness in the relative lateral chain of motorization between the weapon and the turret. FIG. 6 shows the eccentric in the form of a ring-shaped part whose outer wall constitutes the inner race of bearing 27 and whose inner wall constitutes the outer race of bearing 28.

To ensure the low lateral range of the weapon two jacks 32 and 33 are provided, one of which pushes and the other pulls so as to drive the eccentrics 29*a* and 29*b*, thereby causing the weapon to rotate with respect to the bearing 27 and thus with respect to the turret. The rotation of the eccentrics 29*a* and 29*b* in the opposite direction thus allows a lateral angular range of the weapon with respect to the turret and between two limits 1' and 1".

To position the weapon, an absolute position inertial sensor constituted by a gyroscope is used which serves as a reference for the line of sight, the weapon and the mantlet. The gyroscopic sensor is preferentially mounted on the mantlet and may be replaced by a gyrometer that measures the angular velocity of the mantlet, such velocity being integrated so as to materialise the gyroscopic reference position. The absolute position of the cradle is computed using a linear position measurement made in the vicinity of the actuator allowing a torque to be exerted on the weapon. According to the bending stiffnesses of the mantlet and the crushing stiffness of the mantlet-cradle link it is possible for an observer to estimate the radial strain between the weapon's axis of articulation and the tangent at the mantlet, on the trunnions.

What is claimed is:

1. A traverse laying system for a weapon, comprising:

a weapon integral with a frame articulated in traverse with respect to a support providing a large traverse range around a first axis of rotation; and a positioning device for the weapon integral with the frame usable to provide a separate small traverse range of the weapon around a second axis of rotation, the second axis of rotation passing through a centre of gravity of the weapon perpendicular to a longitudinal axis of the weapon, the positioning device comprising:

a cradle supporting the weapon;

a mantlet within which the cradle and the weapon slide during firing of the weapon, the mantlet integral with the frame; and a rotation control device for providing the separate small traverse range of the weapon around a second axis of rotation, wherein the weapon is mounted by means of a joint with respect to the mantlet, the rotation control device provides the rotation of the weapon and the cradle with respect to the mantlet around the second axis of rotation and the rotation control device comprises a jack, a body of the jack is integral with the mantlet and a rod of the jack is connected to the weapon.

2. A traverse laying system for a weapon, comprising:

a weapon integral with a frame articulated in traverse with respect to a support providing a large traverse range around a first axis of rotation; and a positioning device for the weapon integral with the frame usable to provide a separate small traverse range of the weapon around a second axis of rotation, the second axis of rotation passing through a centre of gravity of the weapon perpendicular to a longitudinal axis of the weapon, the positioning device comprising:

a cradle supporting the weapon;

a mantlet within which the cradle and the weapon slide during firing of the weapon, the mantlet integral with the frame; and a rotation control device for providing the separate small traverse range of the weapon around a second axis of rotation, wherein the weapon is mounted by means of a joint with respect to the mantlet, the rotation control device provides the rotation of the weapon and the cradle with respect to the mantlet around the second axis of rotation and the rotation control device comprises a jack, a body of the jack is integral with the weapon and a rod of the jack is connected to the mantlet.

3. A traverse laying system for a weapon, comprising:

a weapon integral with a frame articulated in traverse with respect to a support providing a large traverse range around a first axis of rotation; and a positioning device for the weapon integral with the frame usable to provide a separate small traverse range of the weapon around a second axis of rotation, the second axis of rotation passing through a centre of gravity of the weapon perpendicular to a longitudinal axis of the weapon, the positioning device comprising:

a cradle supporting the weapon;

a mantlet within which the cradle and the weapon slide during firing of the weapon, the mantlet integral with the frame; and a rotation control device for providing the separate small traverse range of the weapon around a second axis of rotation, wherein the weapon is mounted by means of a joint with respect to the mantlet, the rotation control device provides the rotation of the weapon and the cradle with respect to the mantlet around the second axis of rotation, and the joint is of a flexible type, and the flexible type joint comprises two trunnions integral with the cradle and connected to the mantlet by flexible means of low angular stiffness around the second axis of rotation and high stiffness around an elevation axis.

4. A laying system according to claim 3, wherein the rotation of the weapon and the cradle with respect to the mantlet around the second axis includes displacement in opposite directions of two eccentrics between the cradle and the mantlet.

5. A laying system according to claim 4, wherein the rotation control device comprises two jacks working in opposite directions, the bodies of the two jacks are fastened to the cradle and the rods of the two jacks are fastened respectively on each of the two eccentrics, a minimal flexibility of this arrangement being produced by a radial stiffness of elastomer crowns.

6. A laying system according to claim 3, wherein the rotation control device comprises two jacks working in opposite directions, the bodies of the two jacks are fastened to the cradle, and the rods of the two jacks are fastened respectively on each of two eccentrics, a minimal flexibility of this arrangement being produced by radial stiffness of elastomer crowns.

7. A traverse laying system for a weapon, comprising:

a weapon integral with a frame articulated in traverse with respect to a support providing a large traverse range around a first axis of rotation; and a positioning device for the weapon integral with the frame usable to provide a separate small traverse range of the weapon around a second axis of rotation, the second axis of rotation passing through a centre of gravity of the weapon perpendicular to a longitudinal axis of the weapon, the positioning device comprising:

a cradle supporting the weapon;

a mantlet within which the cradle and the weapon slide during firing of the weapon, the mantlet integral with the frame; and a rotation control device for providing the separate small traverse range of the weapon around a second axis of rotation, wherein the weapon is mounted by means of a joint with respect to the mantlet, the rotation control device provides the rotation of the weapon and the cradle with respect to the mantlet around the second axis of rotation, the joint is of a mechanical type, and the rotation control device comprises a jack, the body of the jack is integral with the mantlet and the rod of the jack is connected to the weapon.

8. A traverse laying system for a weapon, comprising:

a weapon integral with a frame articulated in traverse with respect to a support providing a large traverse range around a first axis of rotation; and a positioning device for the weapon integral with the frame usable to provide a separate small traverse range of the weapon around a second axis of rotation, the second axis of rotation passing through a centre of gravity of the weapon perpendicular to a longitudinal axis of the weapon, the positioning device comprising:

a cradle supporting the weapon;

a mantlet within which the cradle and the weapon slide during firing of the weapon, the mantlet integral with the frame; and a rotation control device for providing the separate small traverse range of the weapon around a second axis of rotation, wherein the weapon is mounted by means of a joint with respect to the mantlet, the rotation control device provides the rotation of the weapon and the cradle with respect to the mantlet around the second axis of rotation, the joint is of a mechanical type, and the mechanical type joint comprises a trunnion integral with the cradle supporting the weapon and the mantlet, and bearings integral with the mantlet, and the rotation control device comprises a jack, the body of the jack is integral with the mantlet and the rod of the jack is connected to the weapon.

9. A traverse laying system for a weapon, comprising:

a weapon integral with a frame articulated in traverse with respect to a support providing a large traverse range around a first axis of rotation; and a positioning device for the weapon integral with the frame usable to provide a separate small traverse range of the weapon around a second axis of rotation, the second axis of rotation passing through a centre of gravity of the weapon perpendicular to a longitudinal axis of the weapon, the positioning device comprising:

a cradle supporting the weapon;

a mantlet within which the cradle and the weapon slide during firing of the weapon, the mantlet integral with the frame; and a rotation control device for providing the separate small traverse range of the weapon around a second axis of rotation, wherein the weapon is mounted by means of a joint with respect to the mantlet, the rotation control device provides the rotation of the weapon and the cradle with respect to the mantlet around the second axis of rotation, the joint is of a mechanical type, and the rotation control device comprises a jack, the body of the jack is integral with the weapon and the rod of the jack is connected to the mantlet.

10. A traverse laying system for a weapon, comprising:

a weapon integral with a frame articulated in traverse with respect to a support providing a large traverse range around a first axis of rotation; and a positioning device for the weapon integral with the frame usable to provide a separate small traverse range of the weapon around a second axis of rotation, the second axis of rotation passing through a centre of gravity of the weapon perpendicular to a longitudinal axis of the weapon, the positioning device comprising:

a cradle supporting the weapon;

a mantlet within which the cradle and the weapon slide during firing of the weapon, the mantlet integral with the frame; and a rotation control device for providing the separate small traverse range of the weapon around a second axis of rotation, wherein the weapon is mounted by means of a joint with respect to the mantlet, the rotation control device provides the rotation of the weapon and the cradle with respect to the mantlet around the second axis of rotation, the joint is of a mechanical type, and the mechanical type joint comprises a trunnion integral with the cradle supporting the weapon and the mantlet, and bearings integral with the mantlet, and the rotation control device comprises a jack, the body of the jack is integral with the weapon and the rod of the jack is connected to the mantlet.

* * * * *